US005848347A

United States Patent [19]

Kuo et al.

[11] Patent Number: 5,848,347

[45] Date of Patent: Dec. 8, 1998

[54] DUAL DECURLER AND CONTROL MECHANISM THEREFOR

[75] Inventors: Youti Kuo, Penfield; Ihor Kulbida, Fairport; Alfred Zielinski, Rochester; Steven E. Kolb, Penfield; Roger C. Male, Fairport, all of N.Y.

[73] Assignee: Xerox Corporation, Stamford, Conn.

[21] Appl. No.: 838,637

[22] Filed: Apr. 11, 1997

[51] Int. Cl.[6] ..... G03G 15/00

[52] U.S. Cl. ..... 399/406; 162/271

[58] Field of Search ..... 399/406, 361; 271/188, 209; 162/270, 271

[56] References Cited

U.S. PATENT DOCUMENTS

| | | | |
|---|---|---|---|
| 4,360,356 | 11/1982 | Hall | 493/459 |
| 5,084,731 | 1/1992 | Baruch | 399/406 |
| 5,144,385 | 9/1992 | Tani | 399/406 |
| 5,153,662 | 10/1992 | Foos | 399/406 |
| 5,183,454 | 2/1993 | Kurosawa et al. | 493/459 |
| 5,202,737 | 4/1993 | Hollar | 399/406 |
| 5,392,106 | 2/1995 | Bigenwald et al. | 399/400 X |
| 5,414,503 | 5/1995 | Siegel et al. | 399/406 |
| 5,519,481 | 5/1996 | Kuo | 399/406 |
| 5,539,511 | 7/1996 | Wenthe, Jr. et al. | 399/361 |
| 5,565,971 | 10/1996 | Kuo et al. | 399/406 |

*Primary Examiner*—S. Lee
*Attorney, Agent, or Firm*—Kevin R. Kepner

[57] ABSTRACT

A compact dual decurler mechanism that provides a single straight paper path for achieving bidirectional decurling capability. The dual decurler mechanism consists of two pairs of drive roll and pinch shaft and a camming mechanism for controlling their engagements. The first and the second pairs are oriented in opposite directions in a manner that they can selectively form opposite bending nips for decurling incoming sheets of different curl directions. The operation of the dual decurler can be software controlled through the use of an electric indexing clutch such that, depending on system inputs on image area coverage and the type of finishing device being used, the first pair can be adjusted for toward image (TI) bending, the second pair for away image (AI) bending, or both be set at a neutral setting that keeps both nips open when no decurling is needed. The architecture of the single straight paper path of the dual decurler can minimize paper jams and avoids potential damage to sheets.

11 Claims, 10 Drawing Sheets

DUAL DECURLER AND CONTROL MECHANISM THEREFOR

This invention relates generally to a sheet decurler and control for an electrophotographic printing machine, and more particularly concerns a single path selectively actuated adaptive dual decurler and a control mechanism therefor.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, during the fusing process, toner images are fixed to papers by a heated roll that removes moisture from the paper and, as a result, causes the paper to curl due to moisture and temperature gradients across the thickness of the paper. Many copier machines are equipped with decurlers for reducing curl for improving the reliability of paper handling as well as for customer satisfaction.

Conventional decurlers, however, are not effective in reducing curls in general due to the lack of adjustability in responding to an individual sheet's specific condition. To be effective, a decurler needs to be self-adjusting for applying a proper level of decurling to an incoming sheet according to its image area coverage, paper basis weight and moisture level as conditioned inside the machine. Because incoming sheets may have away from image (AI) or toward image (TI) curl (or need to be bent in either direction), a decurler needs to have bi-directional decurling capability to provide reverse bending to flatten these sheets. Additionally, it is desirable to have the same decurler self-adaptive to different types of output devices being used, which require different orientations of input sheets exiting from image output terminal (IOT), and therefore different curl directions entering a decurler positioned between the IOT and an output device. For example, in some machines, the input simplex sheets for a mailbox are image down (up curl) while those for a disk finisher are image up (down curl) as a result of inversion of output sheets prior to exiting IOT and before entering the disk finisher. Therefore, a common decurler positioned at the exit of an IOT needs to be versatile and capable of flattening both TI and AI curls as any of above-mentioned output devices can be interchangeably connected to the IOT.

Additionally, decurlers have been devised which have separate branches for attempting to decurl sheets depending on the orientation of the bend and/or the image as a sheet exits the IOT. These have shortcomings as often a sheet will jam at the diverter or the image will be exposed to the soft roll which can cause image degradation.

It is desirable to have a compact dual decurler mechanism that provides a single straight paper path for achieving bi-directional decurling capability. The dual decurler mechanism consists of two pairs of drive roll and pinch shaft and a camming mechanism for controlling their engagements. The first and the second pairs are oriented in opposite directions in a manner that they can selectively form opposite bending nips for decurling incoming sheets of different curl directions. The operation of the dual decurler can be software controlled such that, depending on system inputs on image area coverage and the type of finishing device being used, the first pair can be adjusted for toward image (TI) bending, the second pair for away image (AI) bending, or both be set at a neutral setting that keeps both nips open when no decurling is needed. The architecture of the single straight paper path of the dual decurler can minimize paper jams and avoids potential damages to papers.

The following disclosures may relate to various aspects of the present invention.

U.S. Pat. No. 5,519,481

Patentee: Kuo

Issue Date: May 21, 1996

U.S. Pat. No. 5,414,503

Patentee: Siegel et al.

Issue Date: May 9, 1995

U.S. Pat. No. 5,392,106

Patentee: Bigenwald et al.

Issue Date: Feb. 21, 1995

U.S. Pat. No. 5,202,737

Patentee: Hollar

Issue Date: Apr. 13, 1993

U.S. Pat. No. 5,183,454

Patentee: Kurosawa et al.

Issue Date: Feb. 2, 1993

U.S. Pat. No. 5,084,731

Patentee: Baruch

Issue Date: Jan. 28, 1992

U.S. Pat. No. 4,360,356

Patentee: Hall

Issue Date: Nov. 23, 1982

Some portions of the foregoing disclosures may be briefly summarized as follows:

U.S. Pat. No. 5,519,481 An apparatus for adaptive localized sheet decurling in an electrophotographic printing machine. A segmented decurling device forms a drive nip with an elastically deformable surfaced roll. A plurality of sensors are provided to determine the basis weight of the copy sheet, the density of the image being transferred to the copy sheet and fused thereon, the relative humidity of the machine environment, the process speed of the print engine, and any other relevant parameters. Signals indicative of these parameters are generated and sent to the machine controller which processes these signals to determine the degree of curl expected in a sheet. Based on the degree of curl for each sheet section corresponding to a decurler segment, the decurler segment is actuated to a setting which should provide the proper amount of mechanical decurling force. Each segment is activated only for the duration deemed necessary to decurl the imaged sheet portion corresponding thereto.

U.S. Pat. No. 5,414,503 describes an apparatus for adaptive sheet decurling in an electrophotographic printing machine. A plurality of sensors are provided to determine the basis weight of the copy sheet, the density of the image being transferred to the copy sheet and fused thereon, the relative humidity of the machine environment, the process speed of the print engine, and any other relevant parameters. Signals indicative of these parameters are generated and sent to the machine controller which processes these signals and predicts the degree and direction of curl expected in a sheet. Based on the degree of and direction of curl, a bidirectional variable penetration decurler is actuated to a setting which should provide the proper amount of mechanical decurling force.

U.S. Pat. No. 5,392,106 describes a decurling apparatus and method to decurl a substrate in a xerography machine. The invention combines a decurling apparatus having a penetration roller with a small diameter penetrating into a belt. The penetration roller is adjustable and as it pushes into the belt, more decurling of a copy sheet will occur. A controller determines the amount of decurling that is necessary and sends an electrical signal to a driver which operates the penetration roller. The penetration roller is either pressed into or away from the decurling belt. A cam shaft is turned by a motor to cause the cams to move the penetration roller. Although the controller stores the information on the cam location, a home sensor is required to indicate home position. The cam shaft is returned to home position before adjusting the penetration roller to a new level of decurling.

U.S. Pat. No. 5,202,737 discloses an apparatus in which sheet material is decurled. The apparatus includes a rod deflecting a belt to define a nip therebetween. The belt is entrained about a part of spaced rollers. A pair of baffle plates are located at the entrance to the nip and at the exit to the nip. The rod is adapted to translate in a vertical direction. As the rod translates, the degree of deflection is varied and the bend of the sheet adjusted. The baffle plates at both the exit and entrance regions to the nip pivot in unison with the translation of the pivot rod so as to adjust the orientation of the sheet entering and leaving the nip.

U.S. Pat. No. 5,183,454 describes an electrostatic printing machine, a paper curl correction apparatus can vary the amount of curl correction provided by rotating paper guide rollers around a shaft on which paper conveying rollers are provided. As a result, angle between the shaft and a circumference of the paper guide rollers can be varied.

U.S. Pat. No. 5,084,731 discloses an electrostatographic fusing apparatus includes a sheet decurling mechanism that has a curl indicating device and a pair of selectable sheet decurling nips formed by a set of hard rollers and a soft roller. The curl indicating device predicts the degree of toner particle laydown of a toned image on an image frame from the value of charge on such frame relative to a given standard charge value of charge. A copy sheet receiving toned images from an image frame having a charge value higher than such standard charge value is selectively deflected through a first decurling nip where the soft roller directly contacts the toned image side of such a copy sheet in order to induce therein a convex curl.

U.S. Pat. No. 4,360,356 describes an apparatus for removing curl from a continuous moving web. The apparatus includes cylindrical members for supporting and directing the continuous web during its travel and a pair of engagement members between which the web travels. The engagement members are pivotally movable so that either surface of the web can be engaged by one of the engagement members with any desired degree of pressure for removing the curl in the continuous web during travel thereof. If the curl is upwardly, the engagement members are pivoted to engage one surface of the continuous web. If the curl is downwardly, the engagement members are pivoted to engage the opposite surface of the web. The degree of pressure applied for decurl action can be adjusted by adjusting the angle of the engagement members with respect to the line of travel of the continuous web. The apparatus also includes brush members engageable with the web to control the tensional forces upon the web as the web engages one or both of the engagement members.

In accordance with one aspect of the present invention, there is provided a decurling device for selectively applying a decurling force to a sheet having an image formed hereon in an electrophotographic printing machine comprising a substantially straight sheet path, a first decurling nip located in said sheet path, a second decurling nip, adjacent said first nip in said sheet path and a single control device for selectively actuating said first decurling nip, said second decurling nip or neither said first decurling nip or said second decurling nip.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
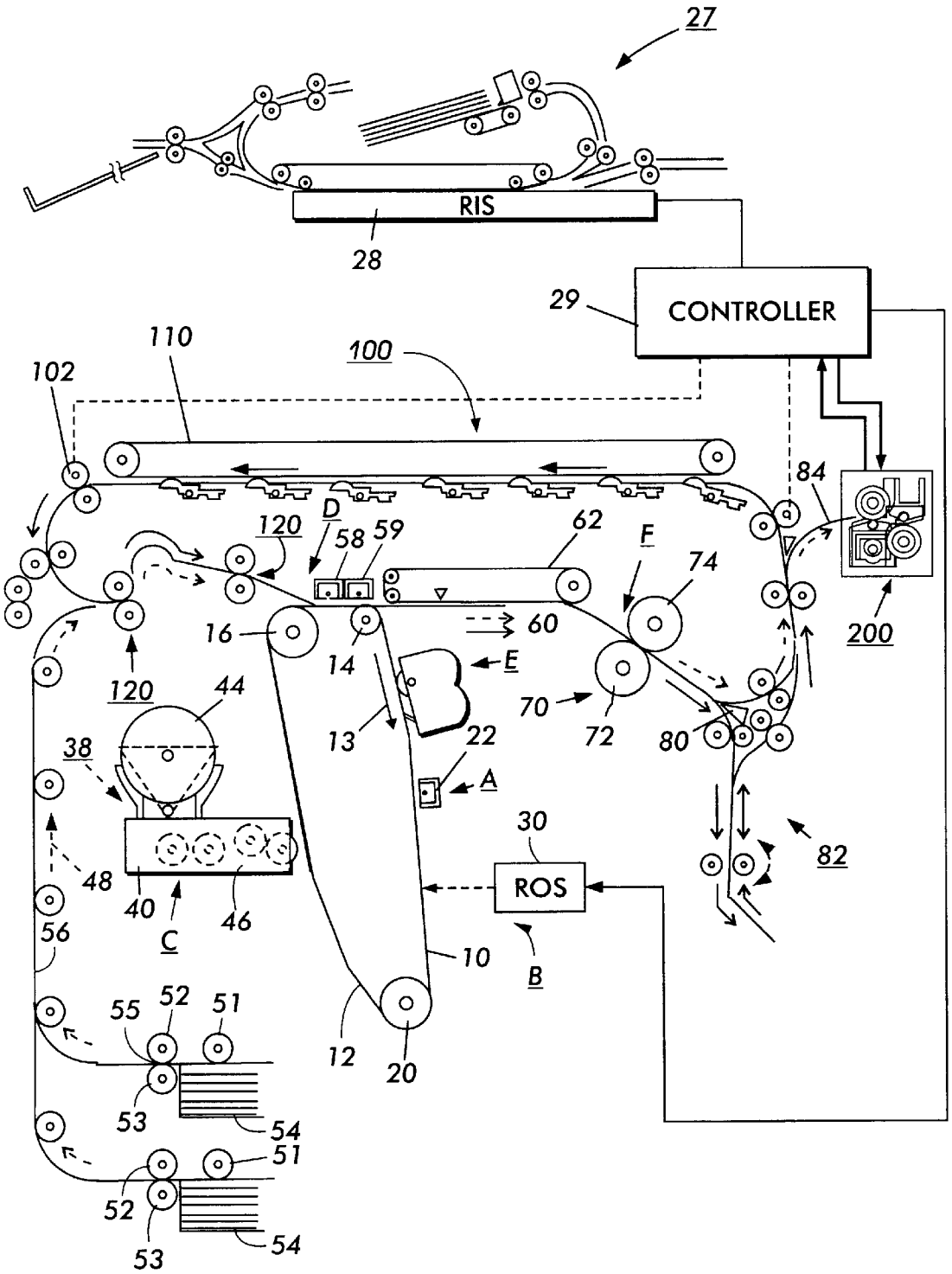
FIG. 1 is a schematic elevational view of a typical electrophotographic printing machine utilizing the dual decurler and control mechanism of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the dual decurler and control mechanism of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84. Sheet path 84 includes the single path bidirectional decurler 200 of the present invention, more fully described below.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
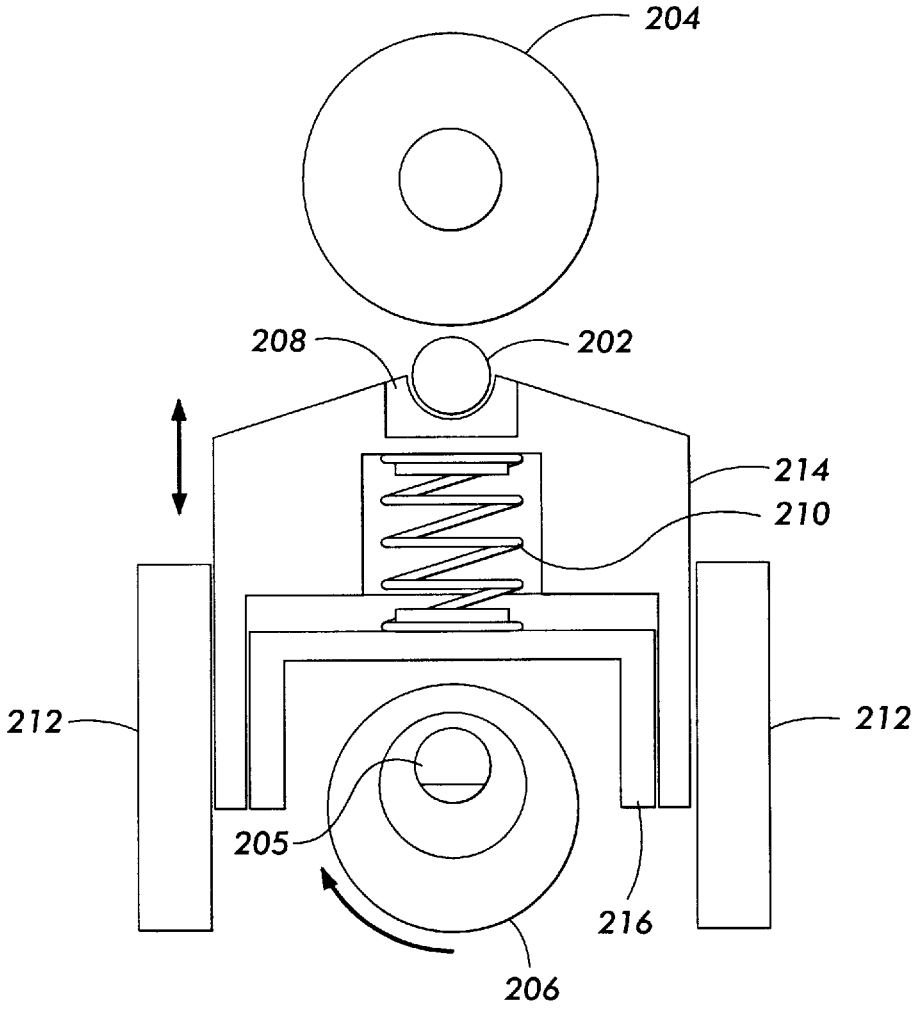
FIG. 2 is a schematic end view of one decurling section of the dual decurler.
Figure 8:
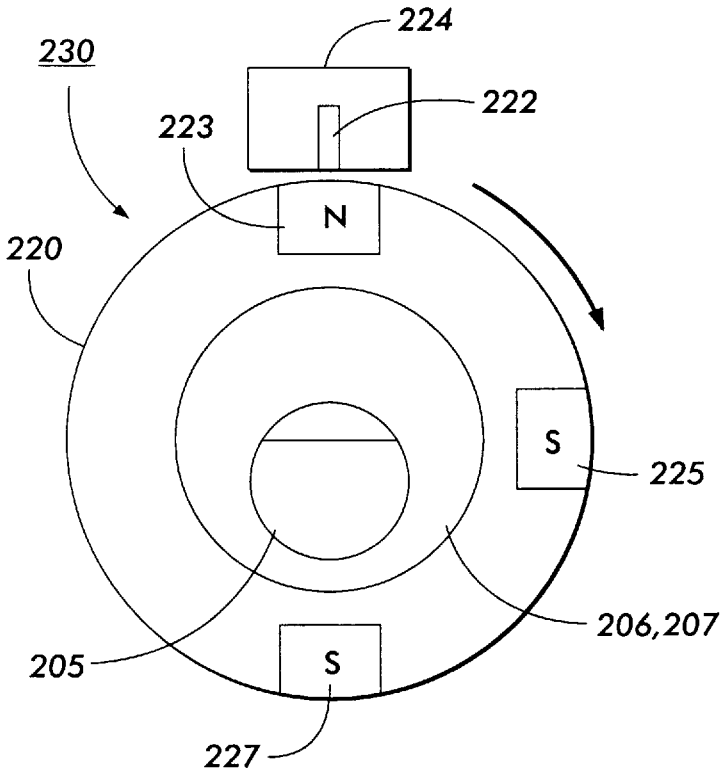
FIG. 8 is an end view of the clutch indicator wheel for the decurler control.

FIG. 2 shows a basic configuration of an indentation decurler, which utilizes a pinch roll 202 to press against an elastomer-layered drive roll 204 to create a mechanical bending nip for decurling a sheet. The pinch roll 202 is spring loaded by the rotation of a cam shaft 205, onto which an electric indexing clutch (see FIG. 8) is mounted. Several cams 206, 207 of the identical profile are aligned on the shaft 205 for even distribution of the total load on the bending nip. The cam 206 profile is specially designed for varying the spring deflection as the cam 206 rotates. Key angular positions and displacements are determined with respect to timing requirements and desirable decurling levels and these positions are used as the magnetic pole positions for the clutch indicator wheel, which is shown in FIG. 8. Note that the indicator wheel 220 and the camshaft 205 move together and are aligned coaxially.

Figure 3:
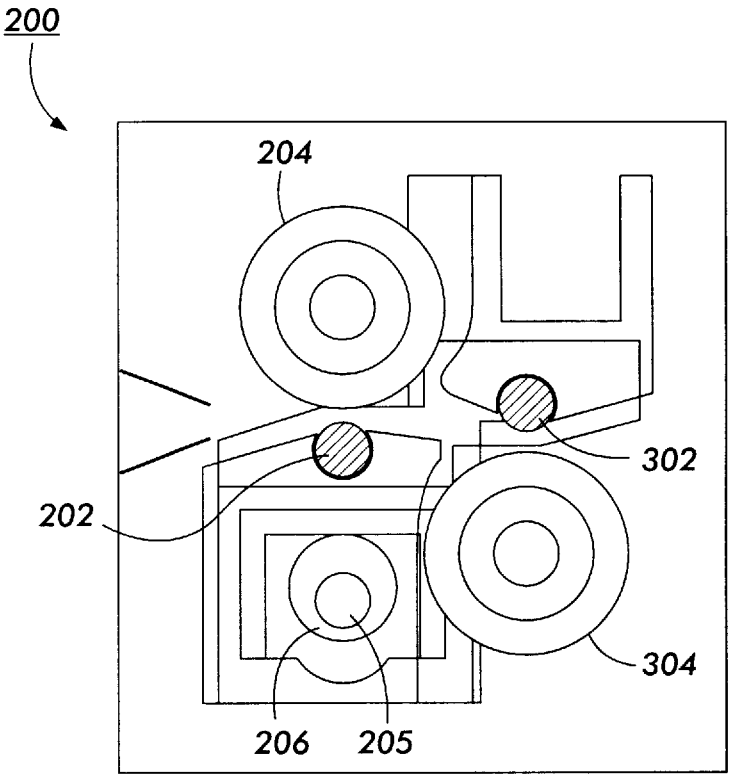
FIG. 3 is a is an end elevational view of the dual decurler of the present invention.
Figure 4:
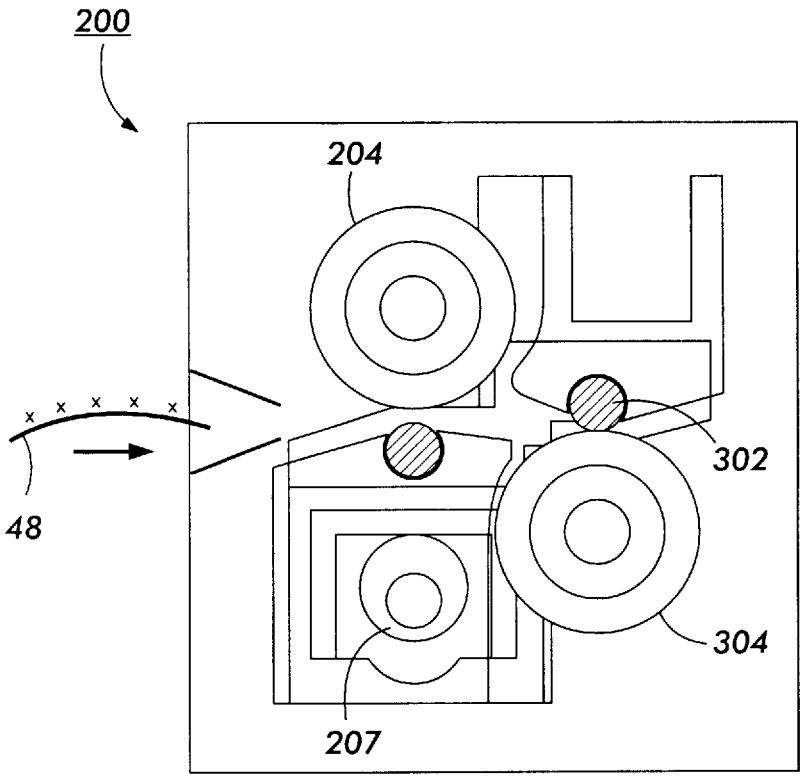
FIG. 4 is an end elevational view of the dual decurler illustrating the actuation of a first decurling mode.
Figure 5:
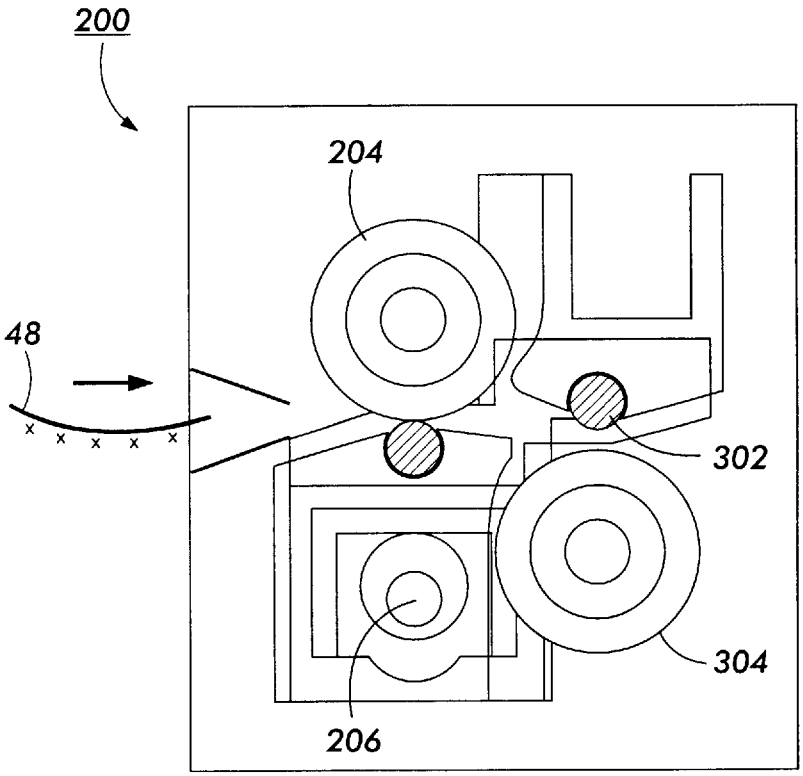
FIG. 5 is an end elevational view of the dual decurler illustrating the actuation of a second decurling mode.

FIGS. 3, 4 and 5 illustrate partial section end views of a dual decurler referred to generally as reference numeral 200, in which two pairs of drive rolls 204, 304 and pinch shafts 202, 302 are positioned in opposite directions to form bending nips. The gaps between the two opposing nips form a straight paper path. The axes of the two drive rolls 204, 304 are fixed with respect to the side frames 230 (FIG. 6). However, the two opposing pinch shafts 202, 302, which are connected by two end caps 232, can be moved together up and down with respect to the drive rolls. FIG. 5 shows that the first pair is engaged forming a TI-bending nip for reverse bending on an incoming up curl sheet and the second pair is open as a result of the movement of the end cap to engage the first nip. FIG. 4 shows the engagement of the second pair 302, 304, for which the first pair 202, 204 is open due to the movement of the end caps 232 in the opposite direction. All these up and down movements of the end caps are driven by the cam shaft 205 as shown in different angular positions in the figures.

Figure 6A:
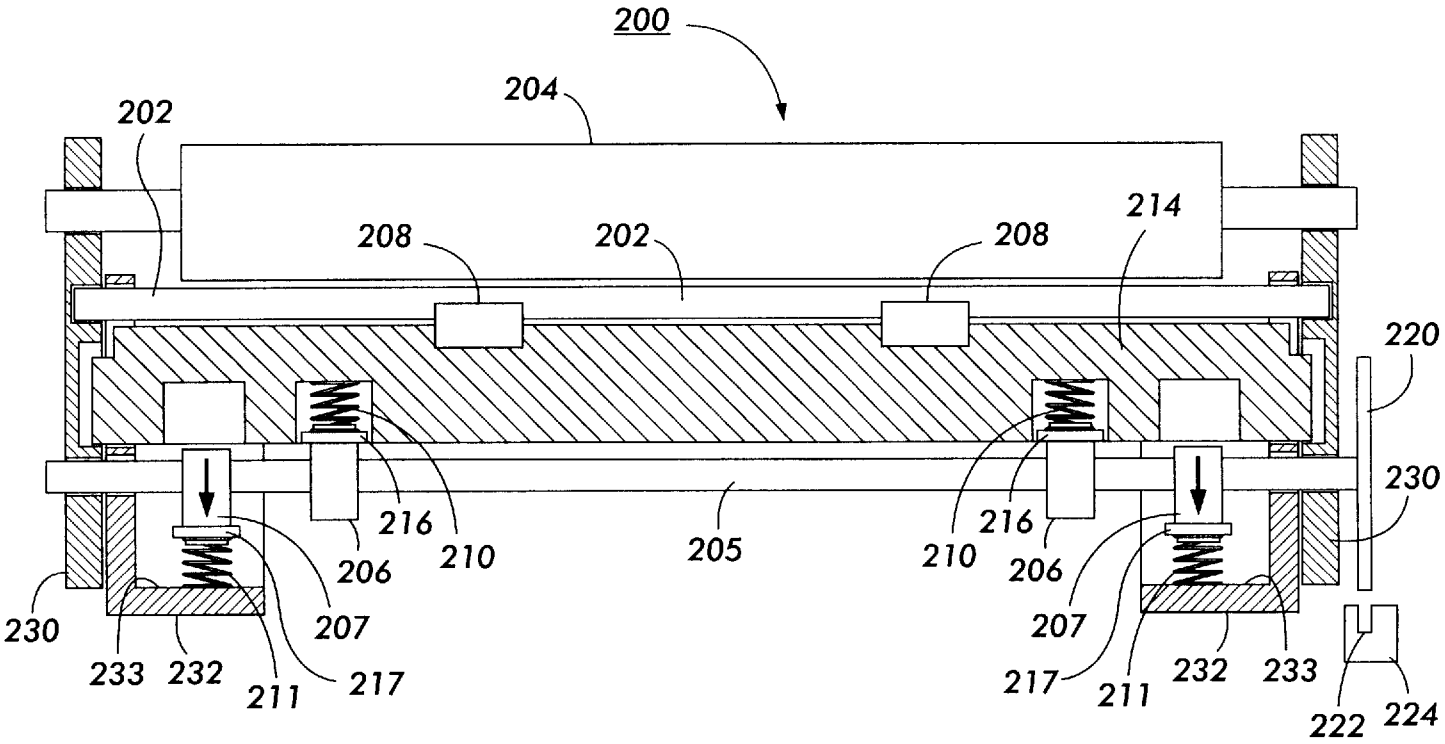
FIGS. 6A and 6B are side partial sectional views illustrating one section of the dual decurler in two different modes.
Figure 6B:
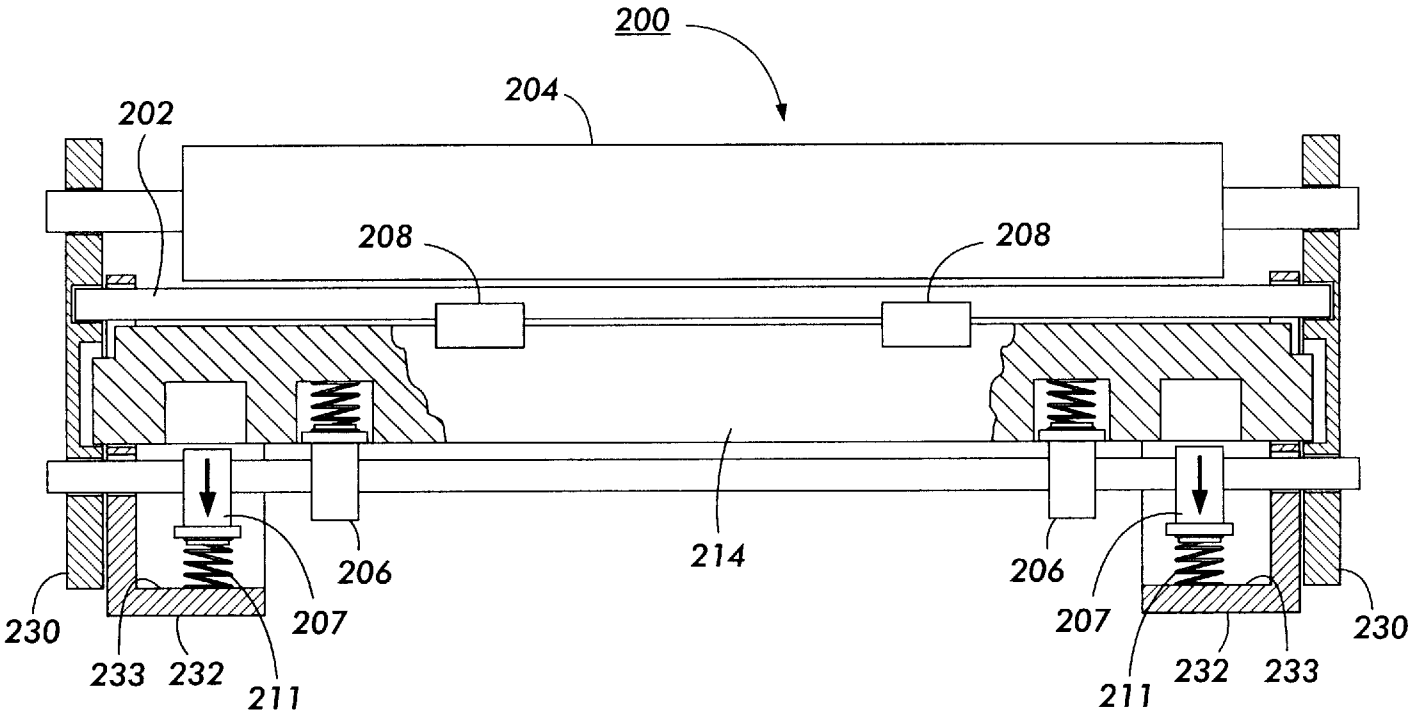

The engagement of the two pinch shafts with the drive rolls is enabled by a single camshaft assembly 205 which has multiple cam lobes positioned along the length of a shaft, which is driven by the drive roll (not shown) of the decurler through a gear chain connection (not shown). As indicated in FIG. 6A, the function of the central two cam lobes 206 is only for loading the first pinch shaft 202 against the first drive roll 204 to form the first bending nip. The decurling or the bending level that relates to the indentation or the penetration of the pinch shaft on the drive roll depends on the travel distance of the cam profile against the bearing support 208 of the pinch roll 202. The central two cams 206 have no effect on the "up movement" of the end caps 232. On the other hand, the two outer cams 207 are for controlling the engagement of the second nip formed by second pinch shaft 302 and second drive roll 304. It is achieved by using the end caps 232 positioned at the two opposite ends of the pinch shaft loading assembly as shown in FIG. 6B. The maximum travel of the outer cams 207 elevates the end caps 232 that cause the second pinch shaft 302 to have maximum penetration on the second drive roll 304 for providing maximum bending. The compression springs 210, 211 are optionally used between the cam lobes 206, 207 and the cam followers 216, 217 and the housing structure 214 to provide cushions for robustness in fit of the component parts and moderation of the dynamic loading torque. The outer cams 207 may be designed to have minimal or no effects on the "down movement" of the end caps 232 by optimizing the compression springs 211 and the spacing of parts between the cam profiles and the pinch shaft 302.

Figure 7:
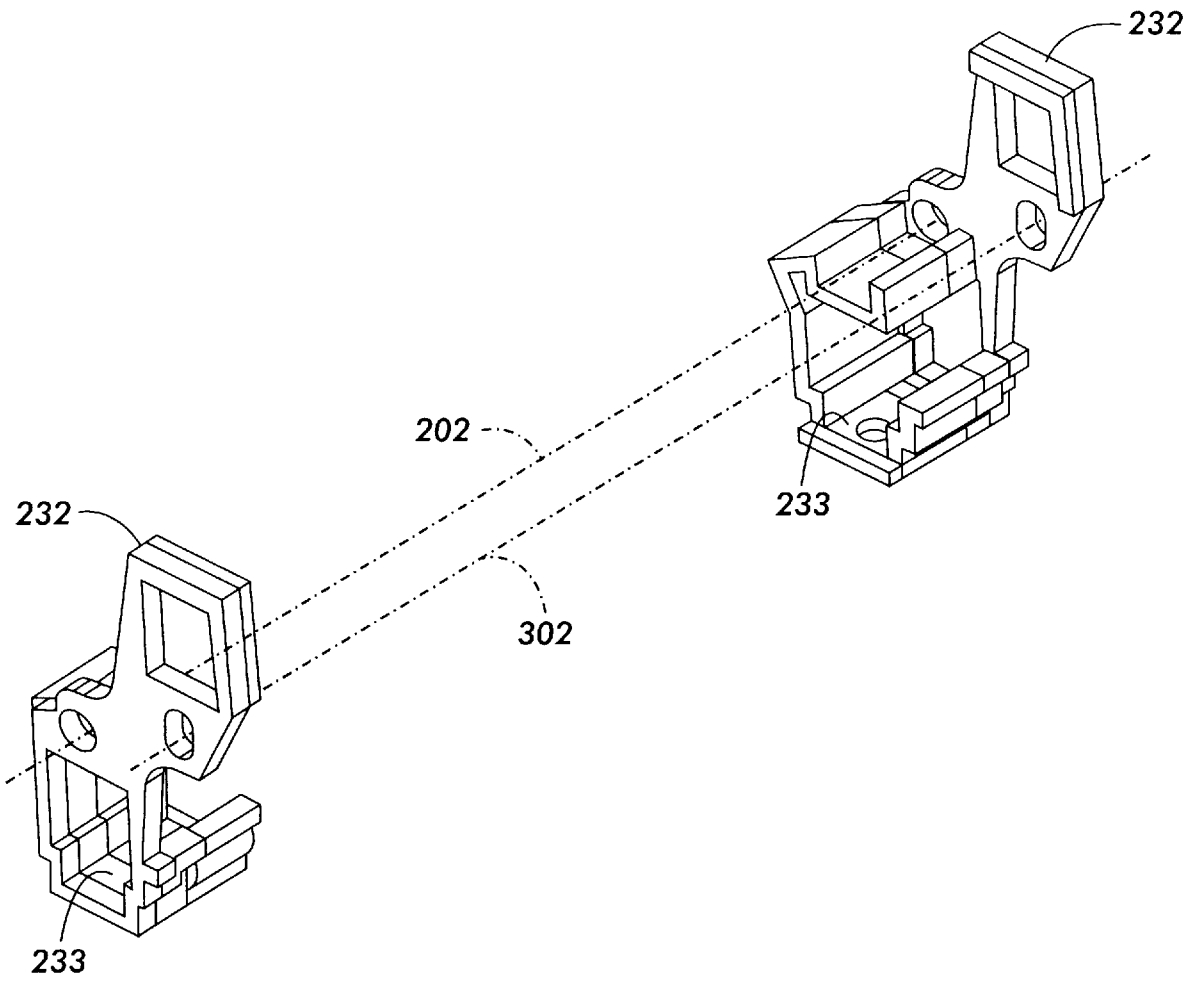
FIG. 7 is perspective view of the end caps of the dual decurler apparatus.

The structure of a end cap 232 is shown in FIG. 7 (also see FIGS. 4, 5 and 6). The rigid structure of the end cap 232 supports the ends of the bearing housings of the first and the second pinch shafts 202, 302 as indicated by the centerlines thereof, so that they can move together by the action of the cam shaft 205 (FIGS. 6A, 6B). The bottom surface 233 as shown in FIG. 6B functions as a follower for the outer cam 207 and spring 211 in order to change the pinch shaft position. When the outer cams 207 are actuated, the nip formed by first pinch roll 202 and first drive roll 204 is open and the nip formed by second pinch roll 302 and second drive roll 304 is closed (not shown in Figure). The control of the angular position of the cam shaft can be achieved optionally by using a stepper motor or an electric indexing clutch (see FIG. 8 and related description), which can be software controlled depending on system inputs of the host machine (IOT).

For compactness and the repeatability of the home and other positions from cycle to cycle (paper-to-paper), FIG. 8 illustrates an electric indexing clutch, generally referred to by reference numeral 230 that is used for the control of the cam position. An electric indexing clutch consists of an electric clutch (schematically represented in FIG. 9), a Hall effect sensor 222, an indicator wheel 220 and a built-in circuit 224. For the decurler application, multiple magnetic poles can be placed in the indicator wheel with only one north pole for indicating the home position (a reference cam position) and other south poles in places for different decurling levels. The key feature of the indexing clutch is that, once triggered, the clutch indicator wheel stops only at the next pole position insensitive to the pulse length as long as the pulse length is shorter than that is required for the indicator wheel to go beyond the next pole, thus ensures the accuracy of the cam positions.

Referring again to FIG. 2 a general configuration of an indentation decurler, which utilizes first pinch roll 202 to press against elastomer-layered first drive roll 204 to create a mechanical bending nip for decurling a sheet. The first pinch roll 202 is spring loaded by the rotation of a cam shaft 205, onto which an electric indexing clutch wheel 220 (see FIG. 8) is mounted. Several cams of the identical profile are aligned on the shaft for even distribution of the total load on the bending nip. The cam profile is specially designed for varying the spring deflection as the cam rotates. Key angular positions and displacements are determined with respect to timing requirements and desirable decurling levels and these positions are used as the magnetic pole positions 223, 225 227 for the clutch indicator wheel 220 as shown in FIG. 8. Note that the indicator wheel and the cam shaft move together.

FIG. 8 shows the relationships between cam positions and the positions of the magnetic poles 223, 225, 227 on the clutch indicator wheel with respect to the spring loading mechanism of the decurler. An example of a 3-pole configuration is given in FIG. 8. As Pole #1 223 passes under the Hall sensor, the built-in circuit disengages the clutch and thus stops the rotation of the cam shaft 205. The Pole #1 overpasses the sensor 222 due to inertia but the overshoot can be neutralized by the mounting bias of the cams with respect to the orientation of the indicator wheel 220. The bias is reflected in the small difference of the orientations of the cams and the indicator wheel 220 (also as seen in the D-shape flat of the shaft). As indicated, the aligned cams are at #1 position as the north pole is under the Hall sensor 222. A subsequent short pulse may drive the cam shaft further until Pole #2 225 is signaled to stop under the Hall sensor 222 and the cams at #2 positions against the springs. Note that the Hall effect does not cause the indicator wheel to stop between the pole locations, which, however, can be caused by the inertia of the cam shaft.

In operation, Pole #1 can be designated as the north pole for the home position (non-decurling or jam clearance) and Pole #2 and Pole #3 (both south poles) are for medium and maximum decurling respectively. In the software control, the cam shaft can be programmed to different pole positions depending on individual sheet's condition. For example, from the non-decurling home position to the maximum decurling, the control software can trigger two short pulses with a programmed interval to drive the cam shaft from position #1 to Pole #3 with momentary stop at #2 position in between.

Figure 9:
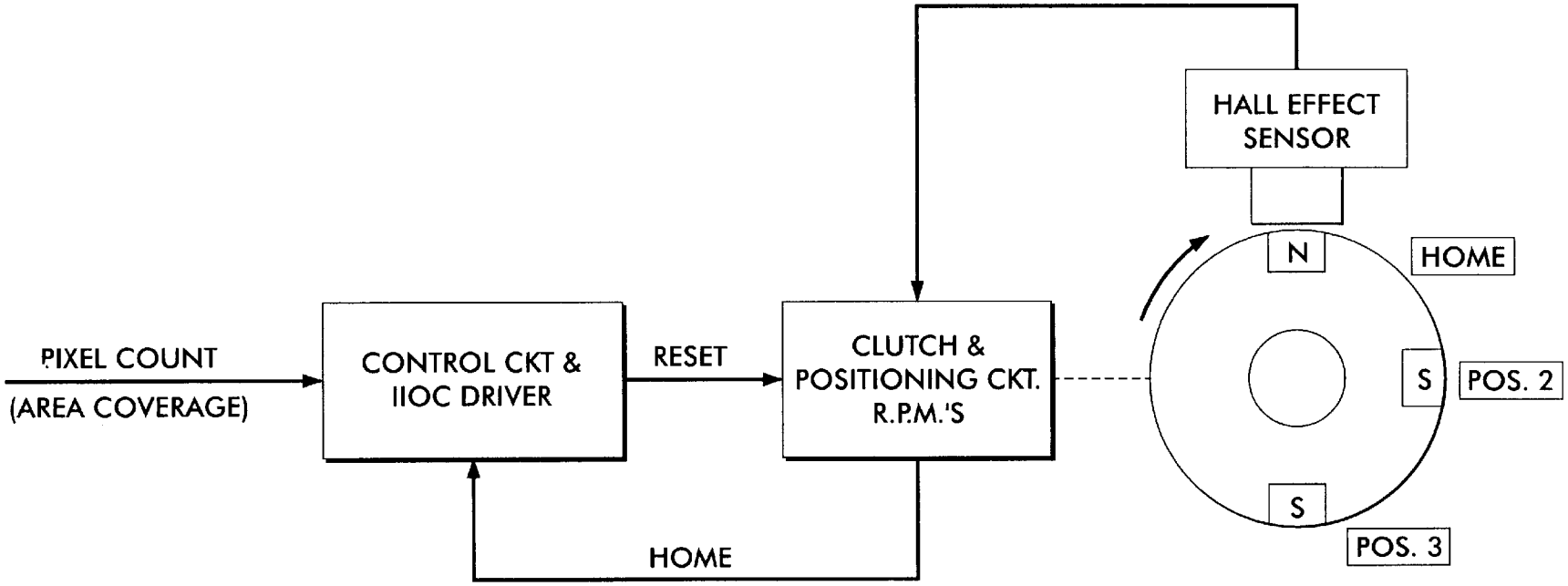
FIG. 9 is a schematic block diagram of the decurler control mechanism.

As shown in FIG. 9 an electric indexing clutch is driven by an Integrated Input Output Connector (IIOC module), which is attached to a five wire bus, composed of 24 vdc, 24vdc return, clock, serial data in and serial data out signal lines. In a machine, the controls to each IIOC module are multiplexed and decoded by the respective module. In practice one IIOC module is dedicated to controlling the electric indexing clutch of a dual decurler. Such a decurler IIOC module contains two inputs and two outputs. One output is used to supply power to the clutch while the second output is used to provide a RESET signal. Furthermore, one input is used to sense HOME position signal while the second input is a reserved spare.

A description of the control circuit is as follows.

Operational sequence always begins from position 1 (HOME). HOME signal is generated by north pole only.

At receipt of HOME signal, the control circuit completes the initialization sequence. In the process of finding and stopping at a destination pole, Clutch control circuit energizes clutch coil upon a RESET signal and de-energizes clutch coil upon detecting either North or South pole on indicator wheel.

At the start of a printing sequence, the control circuit receives an input from machine imaging system, concerning the amount of area coverage on a copy by copy basis (Pixel Count). Depending on this signal the control circuit increments the clutch position by one, two or more pulses to reach a destination pole, thus positioning the decurler shaft and cam to the proper penetration level. In the dual decurler as illustrated the poles can be positioned so that Pole #1 is the Home or the open nips position, Pole #2 can actuate the first decurling nip and Pole #3 can actuate the second decurling nip.

At the end of printing sequence, the control circuit generates multiple reset pulses until a HOME signal is received from the clutch positioning circuit. Upon detecting a HOME signal, the control circuit ceases generating reset pulses. This same sequence could be done at the beginning of the printing sequence as well to ensure that the cam shaft starts at the HOME position at the beginning of a printing job.

Depending on the pixel count (see table 1), the control circuit and associated machine software, generates one, two or more RESET pulses to increment the position of the clutch (sensor wheel 220) to the appropriate position of the decurling cam.

TABLE 1

| Pixel Count | Position |
|---|---|
| A | 1 (north HOME) |
| B | 2 (south 1) |
| C | 3 (south 2) |

The decurler described herein is shown using only three poles so that there is a single penetration level for each decurling nip. A variable degree of decurler can be achieved by using, for example, five pole signals to provide two levels of penetration for each nip. To shorten the travel time between these magnetic poles, a pulse length can be long enough to pass the poles between the starting pole and the destination pole. For example, from position 1 (north pole) to position 3, a RESET pulse length can be longer than that required to stop at position 2 (south pole 1) but shorter than that required to go beyond position 3 (south pole 2). By this manner, this express approach skips local stops so that it shortens the response time of the indexing clutch for copy-to-copy adjustment of the decurling level. A more complex and variable decurling scheme could also be effected using a stepper motor and varying the nip penetration as a function of the angular position of the cam lobe.

Another feature that can be used to control the degree and direction of decurl is that a trigger signal can be sent when a finishing module requiring a certain sheet orientation is attached to the printing machine. The signal can poll a memory in the machine controller which will indicate the image orientation for the particular finishing operation. Alternately, the proper decurling direction may be detected based on the selection of a particular finishing operation and the known sheet orientation associated therewith.

While the invention herein has been described in the context of black and white printing machine, it will be readily apparent that the device can be utilized in any printing machine requiring that a sheet be decurled in one direction or the opposite direction based on sheet conditions and degree of toner coverage.

In recapitulation, there is provided a compact dual decurler mechanism that provides a single straight paper path for achieving bi-directional decurling capability. The dual decurler mechanism consists of two pairs of drive roll and pinch shaft and a camming mechanism for controlling their engagements. The first and the second pairs are oriented in opposite directions in a manner that they can selectively form opposite bending nips for decurling incoming sheets of different curl directions. The operation of the dual decurler can be software controlled such that, depending on system inputs on image area coverage, humidity or paper basis weight and the type of finishing device being used, the first pair can be adjusted for toward image (TI) bending, the second pair for away image (AI) bending, or both be set at a neutral setting that keeps both nips open when no decurling is needed. The architecture of the single straight paper path of the dual decurler can minimize paper jams and avoids potential damage to sheets.

It is, therefore, apparent that there has been provided in accordance with the present invention, a sheet decurler and control therefor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A decurling device for selectively applying a decurling force to a sheet having an image formed hereon in an electrophotographic printing machine comprising:

a substantially straight sheet path;

a first decurling nip located in said sheet path;

a second decurling nip, adjacent said first nip in said sheet path; and a single control device for selectively actuating said first decurling nip, said second decurling nip, neither said first decurling nip or said second decurling nip.

2. An apparatus according to claim 1, further comprising a controller to determine an orientation of toner developed on a sheet and generating a signal indicative thereof, wherein said single control device is responsive to said generated signal so as to actuate the desired first or second decurling nip.

3. An apparatus according to claim 1, wherein said first decurling nip comprises:

a first drive roll and a second drive roll being rotatably supported, said first drive roll and second drive roll having deformable outer coating; and a first pinch roll and second pinch roll being rotatably supported, said first pinch roll being adjucent to the first drive roll for forming first bending nip and said second pinch roll being adjucent to second drive roll for forming second bending nip, wherein said first and second pinch rolls are selectively movable into circumferential contact with said first or second drive roll.

4. An apparatus according to claim 3, wherein said first drive roll and sold second pinch roll are positioned on the same side of said sheet path, whereas sold second drive roll and sold first pinch roll are positioned on the opposite side of the same sheet path such that a bending direction of the first bending nip is opposite to a bending direction of the second bending nip.

5. An apparatus according to claim 4 wherein said control device comprises:

a first frame member supporting said first drive roll and said second drive roll in a fixed relationship;

a second frame member supporting said first pinch roll and said second pinch roll in a fixed relationship, said first frame member and said second frame member being movable with respect to each other; and an actuator adjacent one of said first frame member or said second frame member so as to effectuate relative movement therebetween.

6. An apparatus according to claim 5, wherein said actuator comprises a camshaft having a plurality of camshaft lobes wherein a first group of said plurality of camshaft lobes cooperate with said first frame member and said second frame member to effect actuation of said first decurling nip and a second group of said plurality of camshaft lobes cooperate with said first frame member and said second frame member to effect actuation of said second decurling nip.

7. An apparatus according to claim 6, wherein said control device further comprises:

a signal generating device attached to said camshaft and generating a signal indicative of a rotational position of said camshaft; and a sensor to receive said rotational position signal so as to properly position said camshaft for the desired decurler nip actuation.

8. An apparatus according to claim 7 wherein said signal generating device comprises a disk, coaxially aligned with and rotating in unison with said camshaft, said disk having a plurality of magnetic poles located thereon.

9. An apparatus according to claim 8, wherein said sensor comprise a Hall effect sensor to detect when one of said plurality of magnetic poles is adjacent said sensor.

10. An apparatus according to claim 6, wherein a normal decurling force in said first decurling nip and said second decurling nip is variable as a function of a rotational position of said camshaft.

11. An apparatus according to claim 1, further comprising a finishing device to receive output from said electrophotographic printing machine wherein upon coupling of said finishing device to said printing machine a signal is generated and sent to said control device to effect actuation of the first or second decurling nip.

* * * * *